United States Patent [19]

Ploppa et al.

[11] Patent Number: 4,773,235

[45] Date of Patent: Sep. 27, 1988

[54] DEVICE FOR CONTROL OF A FLAT-BED KNITTING MACHINE

[75] Inventors: Jürgen Ploppa, Pfullingen; Franz Schmid, Bodelshausen; Gerd Mak, Reutlingen; Horst Fries, Reutlingen; Ernst Goller, Reutlingen, all of Fed. Rep. of Germany

[73] Assignee: H. Stoll GmbH & Co., Fed. Rep. of Germany

[21] Appl. No.: 95,004

[22] Filed: Sep. 9, 1987

[30] Foreign Application Priority Data

Sep. 10, 1986 [DE] Fed. Rep. of Germany ..... 8624288
Mar. 6, 1987 [DE] Fed. Rep. of Germany ..... 3707178

[51] Int. Cl.[4] ..... D04B 7/00
[52] U.S. Cl. ..... 66/75.2
[58] Field of Search ..... 66/75.2, 6 X, 60 R

[56] References Cited

U.S. PATENT DOCUMENTS 3,783,642 1/1974 Hadam et al. ..... 66/75.2
4,006,611 2/1977 Kahan ..... 66/75.2
4,081,974 4/1978 Jaffe et al. ..... 66/75.2
4,222,247 9/1980 Hashimoto et al. ..... 66/75.2
4,697,438 10/1987 Muller et al. ..... 66/75.2

FOREIGN PATENT DOCUMENTS 2203528 9/1972 Fed. Rep. of Germany ..... 66/75.2

*Primary Examiner*—Ronald Feldbaum
*Attorney, Agent, or Firm*—Jones, Tullar & Cooper

[57] ABSTRACT

A device for the control of a flat-bed knitting machine for the positional determination at lift reversal of the carriage assembly driven by a reversible motor has a phase-shifted pulse generator device on the carriage assembly which can be moved back and forth and a stationary pulse generator board device in the area of the needle bed arrangement. With such a device a reproducible lift reversal can be performed in the area of the ends of the needle bed as well as at any desired location along the needle bed arrangement, the pulse generator board device has a pulse generator board extending along a needle bed of the needle bed arrangement. During lift reversal the pulse sequences of a pulse generator associated with the pulse generator board are detected in a calculator unit and compared with the pulses associated with the locations for the beginning or alternatively, the end of the lift reversal which have been preset by a program, and the calculator unit performs a speed change during the detection of the lift reversal pulses in dependence an overrun set by the program and the present working speed.

13 Claims, 4 Drawing Sheets

DEVICE FOR CONTROL OF A FLAT-BED KNITTING MACHINE

CROSS-REFERENCE TO RELATED APPLICATION

This application relates in part to application, Ser. No. 094607, filed 9-9-87.

FIELD OF THE INVENTION

The present invention relates to a device for the control of a flat-bed knitting machine for the positional determination during lift reversal of the machine carriage assembly driven by a reversible motor. The device has a pulse generator device on the carriage assembly which can be moved back and forth and a fixed pulse generator board device in the area of a needle bed arrangement of the machine, the pulse generator device generating separate pulse sequences which are phase-shifted in relation to each other during relative movement with respect to the pulse generator board device.

BACKGROUND OF THE INVENTION

The present flat-bed knitting machines in which the carriage assembly is taken along or, alternatively, moved by means of a rotating chain drive actuated by a motor, lift reversal is always performed in a guided manner at the ends of the needle beds or, alternatively, on the other side of their needle areas.

However, later developments in a flat-bed knitting machines are directed towards the use of a reversible drive motor for the back and forth (reciprocal) movement of the carriage assembly in such a way that by control of the drive motor lift reversal can take place not only at the ends of the needle bed arrangement, but also at any location within the needle areas of the needle bed arrangement. Lift reversal means that the carriage arrangement must be braked ahead of the reversing point from its working speed to zero and then accelerated again to working speed. Depending on the working speed and the mass to be braked or accelerated, a fixed amount of time must be made available. Therefore it is has been proposed, starting at the respective end of the knitted material to be produced, to perform a change in the speed of the carriage assembly to zero within a set time.

However, such a time-dependent speed regulation has the disadvantage that it is never possible to reach an exactly defined reversing point on account of values which cannot be precisely determined, such as friction and the like. But a defined reversing point is of fundamental importance in connection with certain functions of the machine, such as, for example, the casting off or, turning off of yarn guides which should always be positioned at a defined location, or the like. Also, in connection with, for example, double or multiple head machines it is important to perform lift reversal in such a way that on the one hand the last head is moved out of the needle area of the needle bed arrangement in which work has been completed and the first head is moved into the needle area of the adjacent material in an exactly defined manner. In case of an indefinite or, respectively, not exactly reproducible reversing point there is the danger that the carriage is moved too far or not far enough.

SUMMARY OF THE INVENTION

It is therefore an object of the present invention to provide a device for the control of flat-bed knitting machines of the type noted above in which lift reversal can be performed in the area of the ends of the needle beds as well as at any desired location along the needle bed arrangement in such a way that a defined, reproducible and, in the case of the reversal within the needle area, needle-exact reversing point is attained.

This object is achieved in a device for the control of a flat-bed knitting machine of the type noted by the fact that the pulse generator board device has at least one pulse generator board extending along at least one needle bed of the needle bed arrangement and preferably extends beyond it at both ends by a length defining the maximum carriage overrun, in that for the purpose of a change of speed of the carriage assembly which is travel dependent, pulse sequences are detected in a calculator unit during the lift reversal of a pulse generator associated with the pulse generator board and are compared with the pulses associated with the locations for the beginning or the end of the lift reversal pulses in dependence on the overrun set by the program and the present working speed.

By the steps according to the present invention a speed regulation dependent on travel is made possible by means of which the carriage assembly can be reversed in a predetermined and also reproducible manner at an exactly defined location within the needle area and thus exactly at a defined needle. If the pulse generator board extends beyond the needle bed, an exact reversing point can also be achieved outside of the needle area.

It is possible, for example, to employ optical as well as magnetic pulse generator/pulse generator board combinations or units. The conditions which must be met are the generation of phase-shifted pulse sequences so that by means of their phase shifts the direction of the lift can be determined, and the pulse generator strip or board having such a high resolution that a needle-exact reversal is possible If in the device according to the present invention a magnetic pulse generator/pulse generator board unit is used it is practical to design such a unit, which is basically known from German Published Patent Application DE-AS No. 21 40 063, to have at least one pulse generator board with a tooth/groove gauge which is equal to or finer than the smallest needle gauge in the needle bed, and an associated pulse generator with resistors that are spaced apart by approximately $\frac{1}{4}$ of a pulse period and generate pulse sequences phase-shifted by $\frac{1}{4}$ of a pulse period, with rectangular control pulses being generated from the pulse sequences. By this a considerably higher resolution of the control or of the pulse generator device is possible without entailing considerable additional effort. By generating a plurality of individual rectangular control pulses within the period created by the pulse generator during the change of the magnetic flow, a needle-exact control is possible within a very short time. Depending on the carriage speed, that pulse out of the plurality of rectangular control pulses which, during the forward movement, corresponds to the pulse expected at the corresponding needle, can be determined. Additionally, the time sequence of these rectangular control pulses alone can be used to determine the lift direction of the carriage so that the pulse generator board is simplified. It is further possible to use, independently of the needle gauge of the needle bed arrangement to be used in the flat-bed knitting machine, the same pulse generator board unit can be used for any needle gauge of a flat-bed knitting machine.

In accordance with a preferred exemplary embodiment of the present invention which includes two pulse generators and two pulse generator boards there is a possibility of a vernier measurement with the aid of a second pulse generator/pulse generator board unit connected with and attuned to the first unit, by means of which an even more exact determination of the position of the carriage within and without the needle area of needle bed arrangement can be performed.

In the first as well as in the second pulse generator/-pulse generator unit intermediate rectangular control pulses are suitably provided such that in an especially simple and quick manner an amount of eight rectangular control pulses within each period of the sinusoidal pulses generated by the pulse generator are available.

It is economically practicable to utilize the same pulse generator for the second pulse generator board as for the first, because the resulting in exactness in the phase-shift of the pulse sequences from the second unit is acceptable.

In accordance with an especially preferred exemplary embodiment of the present invention which includes three pulse generators and three pulse generator boards, the determination of the position of the carriage on the needle bed arrangement has been substantially simplified with respect to the calculating effort required there, because a reference point system is created with the help of a third pulse generator/pulse generator board unit, the reference points of which are dispersed over the length of the needle bed arrangement dependent on defined allocations of the rectangular control pulses of the two units. In other words, the reference points distributed on the third pulse generator along the needle bed determine a very precise location on the needle bed in accordance with the longitudinal measurement or the needle number, so that depending on the application a desired other location can be measured or reached from there. Because of these reference points it is not necessary to determine any desired location by counting from, for example, the starting point at one end of the needle bed.

By providing a calculator unit in which the needle bed gauge and the pulse generator board device/needle bed association is stored a simple possibility for the use of one and the same pulse generator device for the needle bed arrangements with different needle gauges is made available, since it is necessary to provide a mechanically fixed association only once for the needle bed arrangements of the different needle gauges and to feed this association and the needle gauge used, in which the previously mentioned association may be contained, if desired, to the evaluation and calculation unit.

Further details of the invention can be seen from the subsequent description in which the invention is described in detail and explained by means of the exemplary embodiment shown in the drawings.

DETAILED DESCRIPTION OF THE PREFERRED EMBODIMENT

Figure 1:
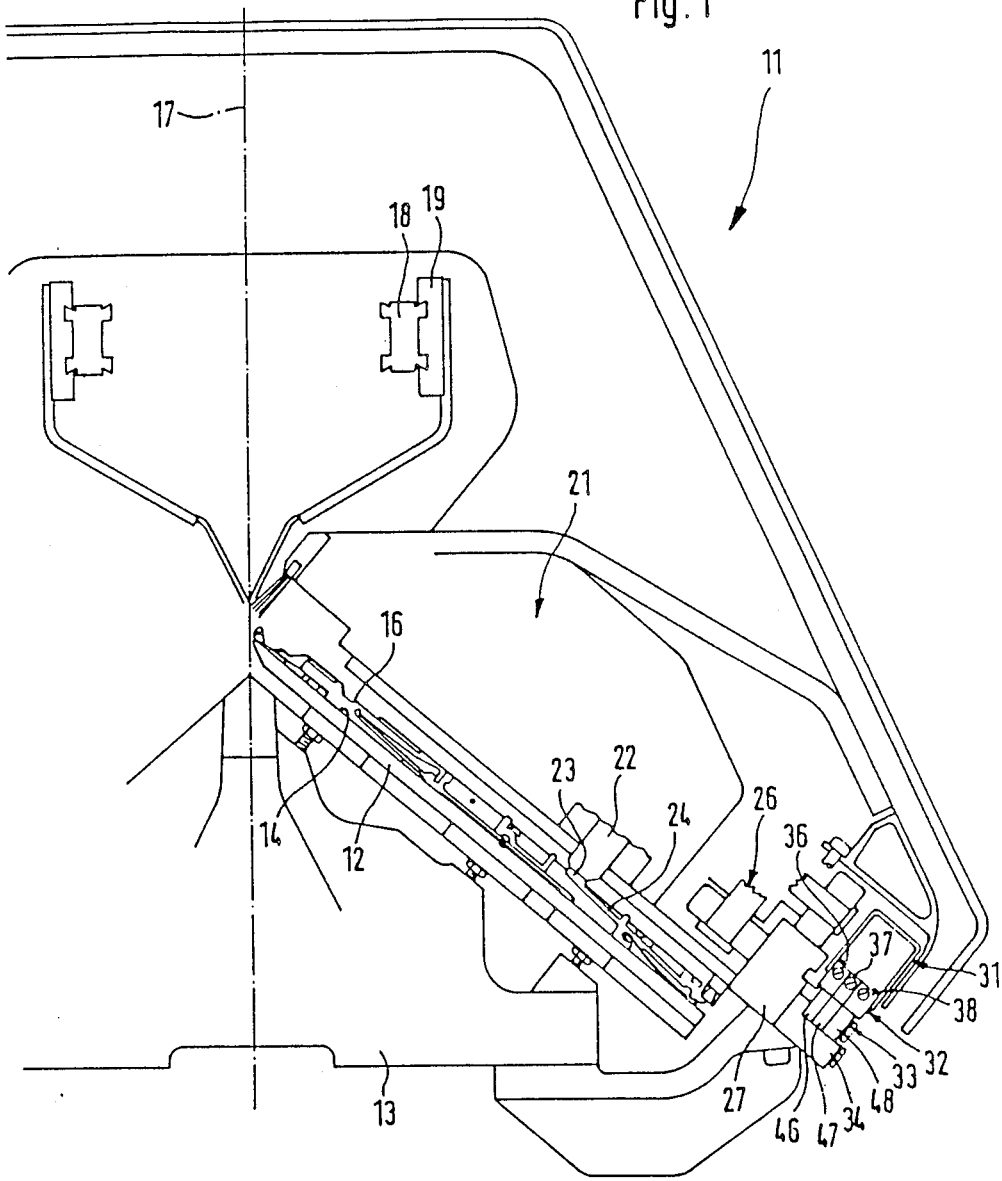
FIG. 1 is a schematic cross section of a flat-bed knitting machine provided with a control device in accordance with the present invention.

FIG. 1 shows a flat-bed knitting machine 11 with a V-shaped needle bed, in which only the area of the front needle bed 12, which is fixed and disposed on a machine elements 13, is shown. The needle bed 12 is provided with longitudinally extending tracks 14 in which the needles 16 are movable back and forth in the customary way with respect to the vertical longitudinal central plane 17 of the flat-bed knitting machine 11. The needle gauge can be optionally chosen. Yarn is supplied to the needles 16 via yarn guides 19 which are fastened to rails 18 extending parallel to the needle bed 12 and which are movable back and forth.

Along the needle bed 12 a carriage 21 is guided movably back and forth which, in addition to corresponding cam parts, supports a needle selection system 22 which, in the exemplary embodiment shown, can press the base 23 of a needle jack 24 into the needle track 14 in the needle bed 12 for the subsequent actuation or non-actuation of the respective needle 16 by cam elements. The carriage 21 is guided by means of a guide roller arrangement 26 on a guide rail 27 fastened on the machine element 13 along the needle bed 12.

The flat-bed knitting machine 11 is provided with a control device 31, the pulse generator device 32 of which is fixed to the carriage 21, and the pulse generator board or control board device 33 of which is fixed in place on the machine element 13 by a board support 34. As can be seen from FIG. 3A, the pulse generator board device 33 does not only extend across the entire length of the needle area of the needle bed 12 but beyond it on both ends by a length L which corresponds to the maximally required overrun of the carriage assembly across the needle area, or alternatively, the needle bed arrangement. This depends on the number of heads on the carriage 21 and the location of the pulse generator device 32 per head on the carriage 21. The pulse generator board device 33 is swept during the movement of the carriage 21 at a short distance by the pulse generator device 32.

Figure 2:
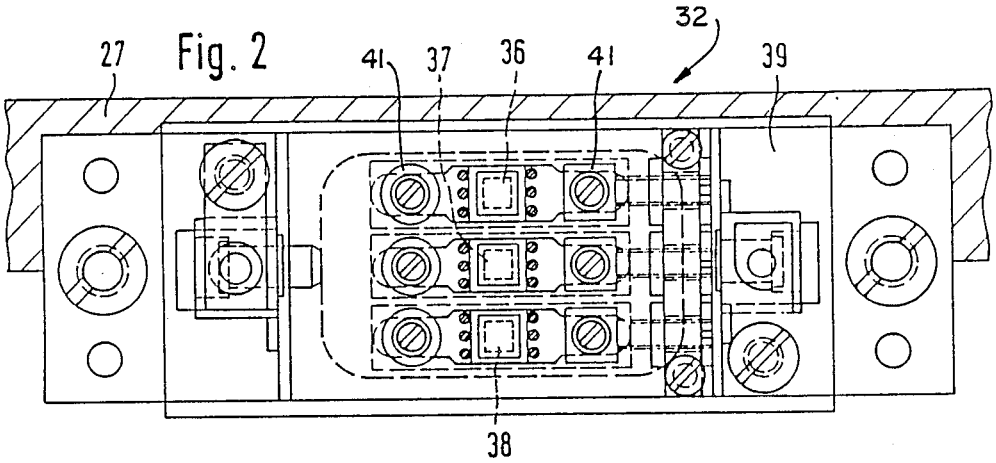
FIG. 2 is a bottom view of the pulse generator device of the control device in accordance with FIG. 1.
Figure 3B:
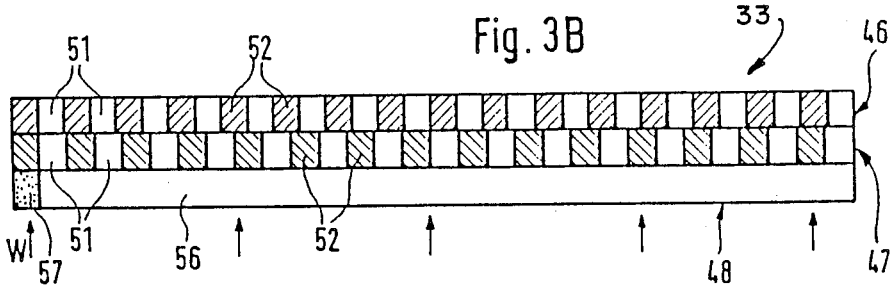
FIG. 3B is a section in enlarged view from the pulse generator board device in accordance with the circle IIIB of FIG. 3A.
Figure 3A:
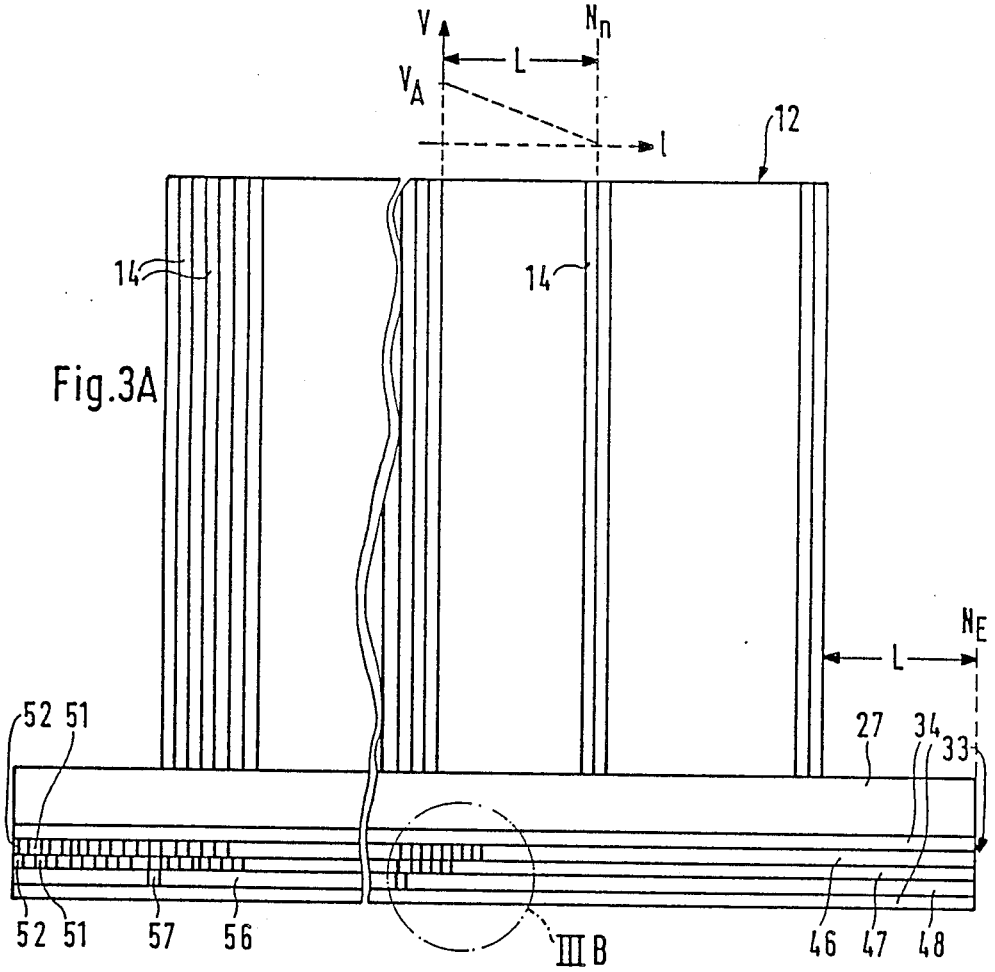
FIG. 3A is a top view of the front needle bed and a pulse generator board device of the control device in accordance with FIG. 1.

FIGS. 2 and 3A show in a schematic bottom and top view the pulse generator device 32 and the pulse generator board device 33, respectively. The pulses generator device 32 has three pulse generators 36, 37 and 38 mounted on gimbals on a support 39 and adjustably fixed. Each of the pulse generators 36, 37 and 38, identical in the exemplary embodiment shown, has magnetically controllable resistors in the form of a double differential magnetoresistors 41, which can be bought commercially in this model with a permanent magnet, as magnetoresistor differential sensors. The pulse generator board device 33 has three equally long pulse generator or control boards 46, 47, 48 arranged parallel and next to each other and extending on both sides beyond the needle area (FIG. 3B), designed as a soft iron element or made permanently magnetic and which are provided in different ways with teeth or grooves. The first pulse generator board 46 is swept or, sensed by the first pulse generator 36, the second pulse generator board 47 by the second pulse generator 37 and the third pulse generator board 48 by the third pulse generator 38. In the course of the sweep of the pulse generator board 46, 47 or 48 by the associated pulse generator 36, 37 or 38 the change in the magnetic field strength, depending on whether a tooth or a groove of the pulse generator board is located opposite the pulse generator, is measured because the magnetic resistance in the mangetoresistors 41 changes depending on the changing magnetic field strength, as described below in connection with FIG. 4. At this point it should be noted that, as in the front needle bed 12, a corresponding pulse generator and pulse generator board device can also be provided at the rear needle bed, not shown, of the flat-bed knitting machine 11, but that it is customarily sufficient to equip these devices on the rear needle bed only with a control device in the form of a first pulse generator and a first pulse generator board.

Figure 5:
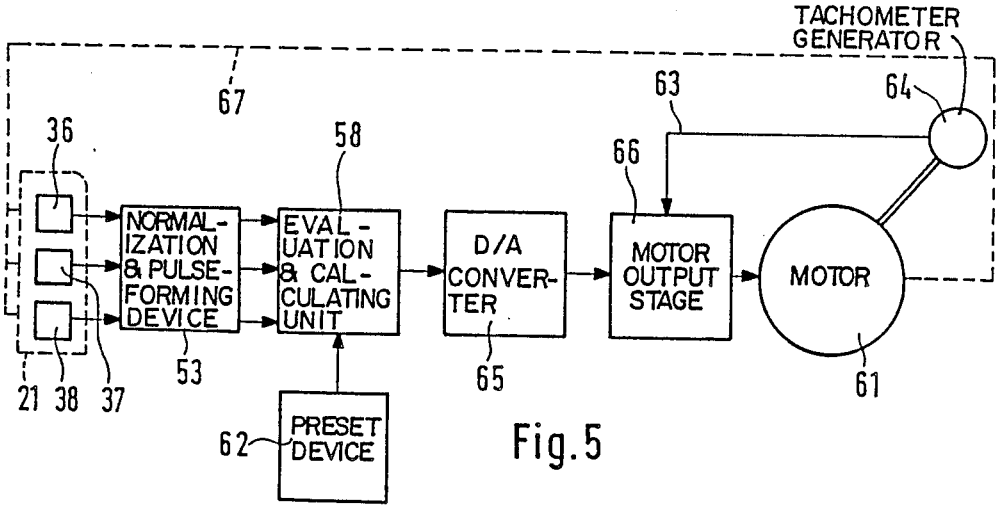
FIG. 5 is a block diagram of a control device in accordance with which the pulses shown in FIG. 4 are generated or processed.
Figure 4:
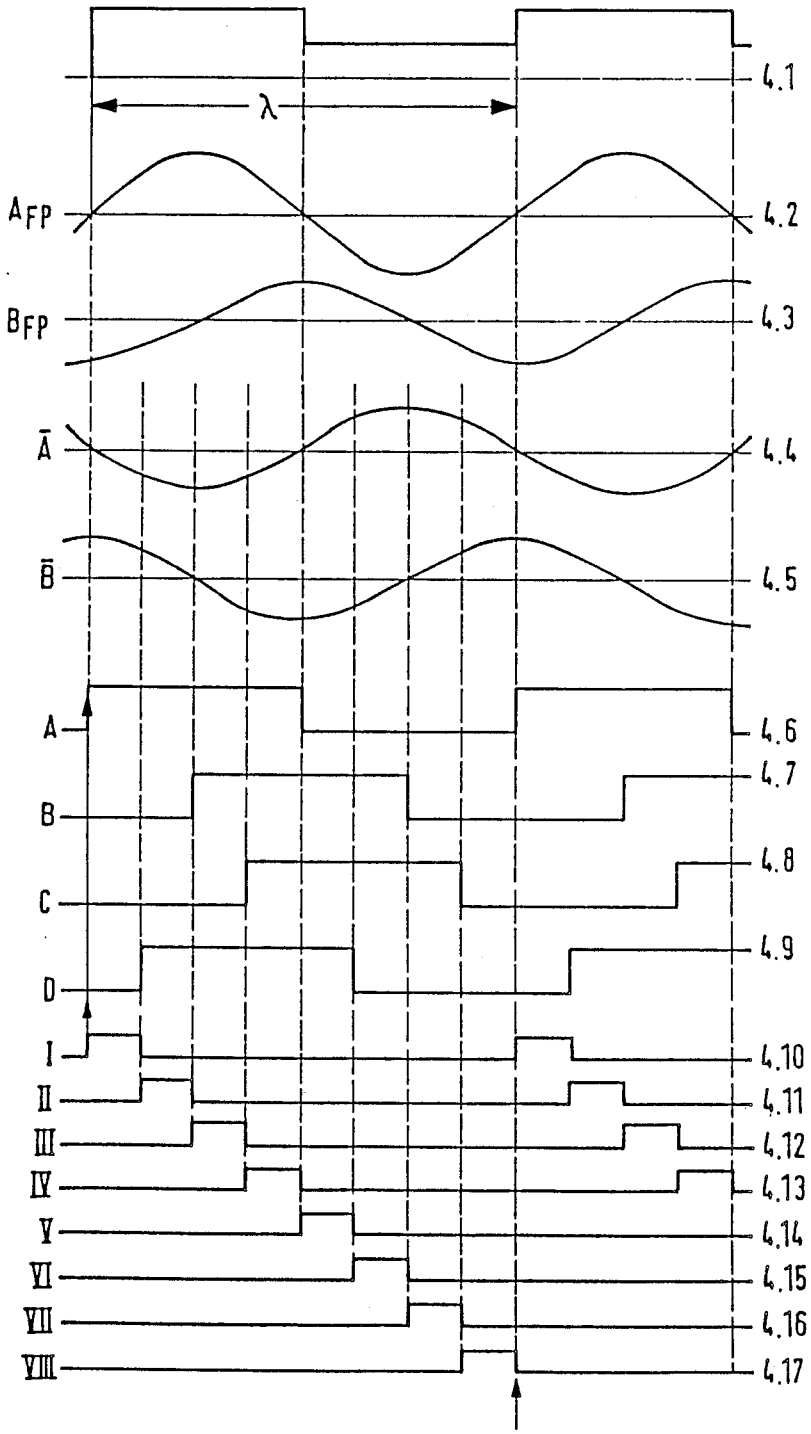
FIG. 4 is a graph of the pulses generated by the control device.

The basic operation of the control units 36/46 and 37/47 of the control device 31 is now described by means of FIGS. 4 and 5. In partial FIG. 4.1 a gauge or period of the pulse generator board 46 or 47, i.e. a tooth or ridge 51 and an adjacent groove 52, are shown. When the pulse generator 36 or 37 sweeps the pulse generator board 46 or 47, the sinusoidal pulse per period or gauge shown in partial FIG. 4.2, i.e. a total pulse sequence of $A_{FP}$, is generated by one pair of the differential magnetoresistors of the pulse generator. The quality of the sinusoidal shape of this pulse sequence $A_{FP}$ depends on the groove/ridge ratio of the pulse generator board. The second pair of the differential magnetoresistors of the pulse generator 36 or 37 is disposed spatially displaced with respect to the first pair of the magnetoresistors of the same pulse generator 36 or 37 by a quarter of the period $\lambda$ of the pulse sequence or by a quarter of the groove/ridge gauge of the pulse generator board 46 or 47, so that the result is the sinusoidal pulse sequence $B_{FP}$, phase-shifted by $\lambda/4$ or $\frac{3}{4}\lambda$, $5/4\lambda$ in accordance with partial FIG. 4.3. In accordance with FIG. 5, these signals are fed to a normalization and pulse-forming device 53. In this device 53 the pulse sequences $A_{FP}$ and $B_{FP}$, are normalized into pulse sequences $\overline{A}$ and $\overline{B}$, because they might have differing amplitudes, as is shown in partial FIGS. 4.4 and 4.5. These normalized sinusoidal pulse sequences $\overline{A}$ and $\overline{B}$ are then transformed in the device 53 into a total of four rectangular pulses A, B, C and D in accordance with the partial FIGS. 4.6 to 4.9. The criteria for transformation are firstly the cross-overs of the pulse sequence $\overline{A}$ (rectangular pulse sequence A) and pulse sequence $\overline{B}$ (rectangular pulse sequence B), then the times when the normalized pulse sequences $\overline{A}$ and B are of equal size (rectangular pulse sequence C) and when the two normalized pulse sequences $\overline{A}$ and $\overline{B}$ are opposed and of the same size (reactangular pulse sequence D).

These four rectangular pulse sequences A–D, phase-shifted with respect to each other, are now transformed per period $\lambda$ into eight shorter rectangular control pulse sequences I to VIII, one single pulse of which occurs per period and of which all pulses occur per period immediately in sequence, i.e. without overlapping, filling the period $\lambda$. In other words, within each gauge of the pulse generator board 46 or 47, consisting of ridge 51 and groove 52, eight pulses I to VIII are generated, as shown in partial FIGS. 4.10 to 4.17.

The specific difference between the two control units 36/46 and 37/47 lies in the gauge of the pulse generator boards 46 and 47. The pulse generator board 46 has a so-called 16-gauge, i.e. per unit of length, for instance an inch, the board is provided with sixteen groove/ridge gauges. This 16-gauge is at least equal to, however in most cases finer than the needle gauge in the needle bed 12. This pulse generator board 46 and the pulse generator 36 associated with it are used in connection with flat-bed knitting machines 11 having a standard needle gauge. The groove/ridge gauge of the second pulse generator board 47 is equipped with a more coarse gauge, namely in the present case with a 15-gauge. This means that the groove/ridge sequence of the pulse generator board 47 is displaced within the given unit of length, for example an inch, against that of the pulse generator board 46 and overlaps differently. This is therefore also true for the pulses generated during the sweep by the respective pulse generators 36 and 37 or, respectively, the eight pulses I to VIII derived therefrom which take up in a defined way respectively a certain different position to each other. This results in a vernier-like disposition of the two pulse generator boards 46 and 47 or the eight pulses I to VIII derived therefrom.

While it is possible to detect the direction of lift of the first pulse generator 36 and thereby of the carriage 21 from the time sequence of those eight pulses I and VIII derived from the control unit 36/46, it is also possible, by means of the vernier-like relation of the respective eight pulses I to VIII, namely between those generated by the control unit 36/46 to those generated by the control unit 37/47, to make an exact determination of the position within the common multiple of the carriage 21 equipped with the pulse generators 36, 27 atop of and at both sides beyond the needle area equipped with the pulse generator boards 46, 47 of the needle bed 12. This exact determination can be easily made within each groove/ridge gauge of the pulse generator boards 46, 47 and thus not only within each needle gauge in the needle bed 12, but on both sides beyond it by the imaginary extension of the needle area with the aid of the extended pulse generator boards 46, 47, since they have an exactly defined spatial position in relation to the needles of the needle bed 12. However, in this type of positional determination of the carriage 21 the individual gauge sectors, i.e. the plurality of the repetition sectors with a length of, for example, one inch (or two inches), must be counted.

To simplify the latter, the above mentioned third control unit 38/48 has been provided, consisting of the pulse generator 38, which can be identical to the pulse generators 36 and 37, and of the pulse generator board 48. This unit 38/48 is used for the generation of reference marks to show within which of the sectors of, for example, the unit of length of one inch the carriage 21 is atop the needle bed 12. For this purpose the pulse generator board 48 is only provided with a groove 57 at individual discrete places, while the ridge 56 is made continuous. The choice of the discrete values is determined by those locations where those pulses I to VIII derived from the first unit 36/46 have a certain differentiable and measurable concrete relation to each other with those rectangular control pulses I–VIII derived from the second unit 37/47. For example, this can be specified by one of the pulses of the second unit 37/47 coinciding with another of the pulses of the first unit 36/46 or by the appearance of a certain pulse of the second unit 37/47 during the change of another pulse of the first unit 36/46. In this manner it is possible to determine, for example, five to ten discrete values W which can be reasonably differentiated and to such positions or points in time is assigned a reference mark, i.e. a change from the ridge 56 to the groove 57 in the third pulse generator board 48. However, these possible discrete values are distributed over the plurality of the repetition sectors, within which, with the aid of the first and second units, a positional determination along the needle bed 12 is possible. This means that reference marks are provided, distributed over the needle bed, which can indicate a certain position, so that counting of the successive repetition sectors can either be considerably reduced to the number respectively provided between two reference marks or, if counting is continued, can serve as a check only.

The reference marks are distributed along the needle bed 12 and, if necessary, extending beyond it (overrun L) in such a way that under any imaginable operational condition at least one of these reference marks W on the pulse generator board 48 is sensed by the associated pulse generator 38 fixed on the carriage arrangement.

The third unit 38/48 functions as usual, i.e. the signals emitted from the third pulse generator 38 are used directly or only by transformation into a rectangular pulse. The calculated association and determination of the reaching of the reference marks is performed in the evaluation and calculation unit 58 in accordance with FIG. 5, with which the third control unit 38/48 is also connected, if necessary via the pulse-forming unit 53.

It is possible with the aid of these reference marks W to position the carriage at the beginning of the knitting operation at the exact needle position of the desired starting position by moving the carriage to the reference mark next following, and from there being able to move it to the associated needle where knitting is to start by means of the positional determination by the vernier-like disposition of the first and second pulse generator boards 46 and 47. During operation the reference marks are used during the respective passing of the carriage 21 to check by means of the vernier association and the association of the reference marks thereto and to a defined needle number whether work proceeds accurately or whether errors, for example in the pulse generator system, are present, as well as to reach the exact reversing point in a pre-programmed way during lift reversal with the aid of the positional determination by the vernier-like disposition of the other two pulse generator boards 46, 47.

By means of FIG. 3A and the block diagram of FIG. 5 the positional determination of the carriage assembly 21 driven by a reversible motor 61 before, during and after carriage lift reversal is described, during which lift reversal phase, a speed change of the carriage assembly 21 is performed with the aid of the calculator unit 58. A preset device 62, which is connected with the calculator unit 58, not only presets the working speed of the carriage arrangement according to a program, but also the respective width of the material to be knitted, i.e., the width of the needle area in the needle bed 12 used in the operation and by that the locational area of the lift reversal. Further, the size of the lift reversal path L within which the carriage assembly must be braked from working speed $V_A$ to zero or, again accelerated from there to working speed, and the exact location of the reversing point are preset for the lift reversal area. This reversing point can lie outside of the needle area used for the respective material to be knitted, and it can be located outside of the needle area itself (Pos. $N_E$) or within the entire needle area of the needle bed and thus, if required, within the adjacent material to be knitted, (needle $N_n$) or present material to be knitted (for example when pockets are added). To do this it is necessary to preset, reach or maintain the reversing point needle-correct or, in case it lies outside the needle bed at the exact location. This means that the reversing point and, via the previously set lift reversal path L, the start and end points of the lift reversal phase are stored in the calculation unit 58 in the form of pulse combinations associated with these points of the pulses emitted by the three pulse generator boards 46 and 48. The pulse sequences emitted during operation by the pulse generator boards 36 and 38 are now compared in the calculation unit 58 with the pulses determining the end or, intermediate points of the lift reversal phase, so that the calculation unit 58 effects or, determines, when reaching the starting point, a corresponding change in the speed of the carriage assembly in such a way that zero speed is attained exactly at the reversing point $N_E$ or, $N_n$. By means of a feed back 63 of the output of a tachometer generator 64 is connected with the motor 61 to a motor output stage 66 disposed between the calculation unit 58 or, its D/A converter 65 and the motor 61, a set point/actual value comparison is performed. A closed control loop is indicated by the drive or, mechanical connection 67, shown by a dashed line, from the motor 61 to the carriage 21 which supports the pulse generators 36 to 38. This closed control loop allows the path-dependent speed change of the carriage arrangement in such a way that a preset reversing point can be reached exactly and reproducably.

During assembly of a flat-bed knitting machine 11 the needle bed 12 and the device 33, consisting of three pulse generator boards 46 to 48, are disposed in such a way that a per se random location along the corresponding needle bed 12 one of the reference marks of the pulse generator board 48 is formed by the groove 57 has a fixed association point. This fixed reference point or this defined needle track can be located in the corresponding needle bed, for example at its end, preferably, however, in a central location. This definite association is performed mechanically in such a way that the device 33 with the pulse generator boards 46 to 48 fixedly arranged in relation to each other is pinned to the corresponding needle bed in such a way that one edge of the groove 57 or of the reference mark is flush with an edge of the corresponding needle track 14 in the needle bed 12. A corresponding association between pulse generator device 33 and needle bed 12 takes place in the individual machines with the use of the same needle gauge always at the same place, a corresponding association in connection with each needle gauge for gauge of, for example, between $2\frac{1}{2}$ and 12, is newly determined in a corresponding manner. In other words, although a particular association to one of the reference marks of the pulse generator device 33 is selected for needle beds of different gauges, the respective pulse generator boards 46 to 48 or their fixed disposition and association with each other remain. The use of a needle bed 12 of a certain gauge and its fixed association with a reference mark of the pulse generator device is fed to the evaluation and calculation unit 58 and is referenced there with the gauge of the pulse generator board 46.

It is to be understood that the exemplary embodiment described above has been shown only by way of example and that further embodiments and improvements are possible within the scope of the invention.

What is claimed is:

1. A device for the control of a flat-bed knitting machine for the positional determination of a reciprocating carriage assembly on the needle bed arrangement of the machine during lift reversal, comprising:

a fixed pulse generator board device in the area of the needle bed arrangement, said pulse generator board device having at least one pulse generator board extending along at least one needle bed, and preferably beyond both ends of the needle bed by a length defining the maximum carriage overrun;

a pulse generator device mounted on a carriage assembly, which generates separate pulse sequences during relative movement with respect to said pulse generator board, said separate pulse sequences being phase-shifted relative to each other; and a calculator unit to which said separate pulse sequences are fed, said calculator unit having a program stored therein according to which the beginning and end of a lift reversal are defined, said calculator unit comparing said separate pulse sequences with pulses associated with the programmed beginning and end of a lift reversal and producing a speed change in dependence on the overrun set by the program and the present working speed.

2. The device as defined in claim 1, wherein during a lift reversal inside the needle area the location for the end of the lift reversal is determined by a defined needle in the needle bed.

3. A device for use with the needle bed arrangement of a flat-bed knitting machine, comprising:

a pulse generator device having at least one pulse generator and magnetically controllable resistors associated therewith, the resistors being spaced apart by approximately $\frac{1}{4}$ of a pulse period, said resistors generating separate pulse sequences which are phase-shifted with respect to each other by approximately $\frac{1}{4}$ of a pulse period;

a magnetically conducting pulse generator board device having at least one pulse generator board possessing a tooth/groove gauge equal to or finer than the smallest needle gauge in the associated needle bed arrangement, said pulse sequences being generated as a function of a tooth/groove gauge of a pulse generator of the resistors generating said pulse sequences; and means for receiving the separate pulse sequences and at pre-determined intervals, generating several successive rectangular control pulses from said pulse sequences.

4. The device as defined in claim 3, wherein the rectangular control pulses are generated by detecting pulse sequence crossover.

5. The device as defined in claim 3, wherein the rectangular control pulses are generated by normalizing said pulse sequences and comparing the normalized pulse sequences.

6. The device as defined in claim 3, wherein the rectangular control pulses are generated by detecting pulse sequence crossover, and by normalizing said pulse sequences and comparing the normalized pulse sequences.

7. The device as defined in claim 3, wherein:

eight rectangular control pulses are generated per period of said pulse sequences by the derivation of four different intermediate rectangular pulse sequences from the points in time of the crossovers of said pulse sequences and the points in time at which the pulses of said pulse sequences are equal in size or opposedly equal in size, the width of said intermediate rectangular pulse sequences correspond to their phase shifting.

8. The device as claimed in claim 3, wherein:

the pulse generator device has two pulse generators and associated magnetically controllable resistors, the resistors of the second pulse generator being spaced apart by approximately $\frac{1}{4}$ of a pulse period, and generating second separate pulse sequences which are phase-shifted with respect to each other by approximately $\frac{1}{4}$ of a pulse period;

the magnetically conducting pulse generator board device has a second pulse generator board, the tooth/groove gauge of which differs in the direction toward coarse from that of the first pulse generator board; and several successive second rectangular control pulses are generated from the second pulse sequences and a comparison of the relative positions of the first and second rectangular pulses is made in the manner of a vernier measurement.

9. The device as defined in claim 8, further wherein eight rectangular control pulses are generated per period of said pulse sequences by the derivation of four different intermediate rectangular pulse sequences and the points in time at which the pulses of said pulse sequences are equal in size or opposedly equal in size, the width of said intermediate rectangular pulse sequences correspond to their phase shifting.

10. The device as defined in claim 8, wherein the first and second pulse generators are equal.

11. The device as defined in claim 8, further wherein:

the pulse generator device has three pulse generators and associated magnetically controllable resistors;

the magnetically conducting pulse generator board device has a third pulse generating board having a plurality of grooves; and the plurality of grooves of said third pulse generator board being associated with certain values associated with certain values associated with the first and second pulse generator boards extending next to each other.

12. The device as defined in claim 11, further wherein:

the plurality of grooves comprises five to ten grooves.

13. The device as defined in claim 3, wherein:

an evaluation and calculation unit connected to said means generating successive rectangular control pieces; and the magnetically conducting pulse generator board device has a definable and mechanically fixed association with a corresponding needle bed or gauge.

* * * * *